United States Patent [19]

Ely et al.

[11] 4,191,514

[45] Mar. 4, 1980

[54] PUMPING ARRANGEMENTS TO CONSERVE ENERGY

[76] Inventors: Richard H. Ely, 6609 Gazette Ave., Canoga Park, Calif. 91306; Larry E. Haynes, 22350 Paraguay, Saugus, Calif. 91350

[21] Appl. No.: 806,189

[22] Filed: Jun. 13, 1977

[51] Int. Cl.[2] ..... F04B 21/04; F04B 39/10; F04B 43/02

[52] U.S. Cl. ..... 417/529; 417/566

[58] Field of Search ..... 92/98 D; 417/521-539, 417/566, 554, 480, 472, 473

[56] References Cited

U.S. PATENT DOCUMENTS

| | | | |
|---|---|---|---|
| 109,678 | 11/1870 | Shearer | 417/536 |
| 220,350 | 10/1879 | Coshier | 74/108 |
| 226,019 | 3/1880 | Beebe et al. | 417/552 |
| 237,175 | 11/1881 | Flanagan | 417/480 |
| 517,902 | 4/1894 | Tom et al. | 417/531 |
| 862,867 | 8/1907 | Eggleston | 417/390 |
| 1,145,528 | 7/1915 | Train | 417/552 |
| 1,408,092 | 2/1922 | Keller | 417/534 |
| 1,891,771 | 12/1932 | Mendenhall et al. | 417/539 |
| 2,463,766 | 3/1949 | Hadley | 417/566 |
| 2,744,468 | 5/1956 | Porter | 417/529 |
| 2,902,049 | 9/1959 | Ilfrey et al. | 417/566 |
| 3,327,633 | 6/1967 | Duinker et al. | 92/98 D |
| 3,488,763 | 1/1970 | Loquist, Jr. | 92/98 D |
| 4,049,365 | 9/1977 | Sparks | 417/554 |

*Primary Examiner*—William L. Freeh

*Attorney, Agent, or Firm*—Albert M. Herzig; Edward C. Walsh

[57] ABSTRACT

Unique constructional improvements in constructions involved in pumping. The invention is particularly adapted in deep well pumps which may be water or oil pumps or otherwise. The invention greatly reduces the mass of moving parts thereby proportionately reducing the energy required for pumping operations. Dual pistons are utilized which reciprocate oppositely, being connected by a cable passing over a pulley. Heavy sucker rods and pistons are eliminated. The pistons are light-weight with light-weight bellows-type seals. The pistons are activated by way of cables rather than sucker rods. Further gains are realized by minimizing the size of the piping utilized. This end is realized by way of an offset staggered relationship of the operating pistons in a smaller pipe or by way of plural pistons arranged in vertical array or assembly.

2 Claims, 16 Drawing Figures

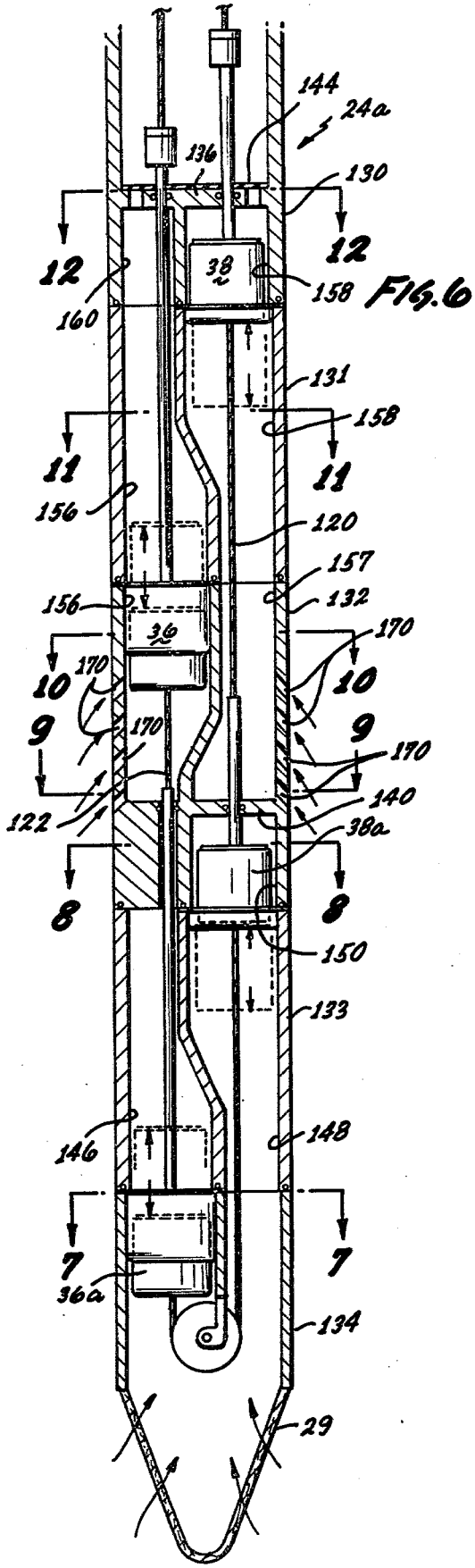
FIG. 6
FIG. 7
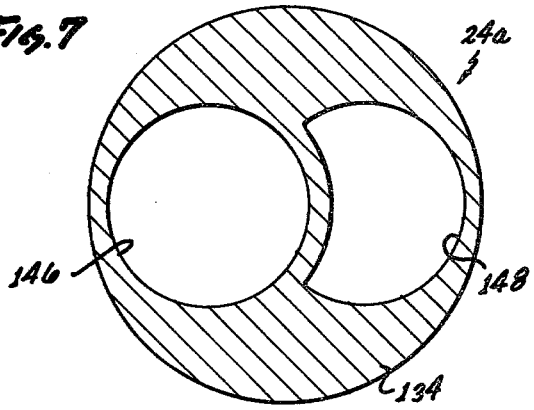
FIG. 8
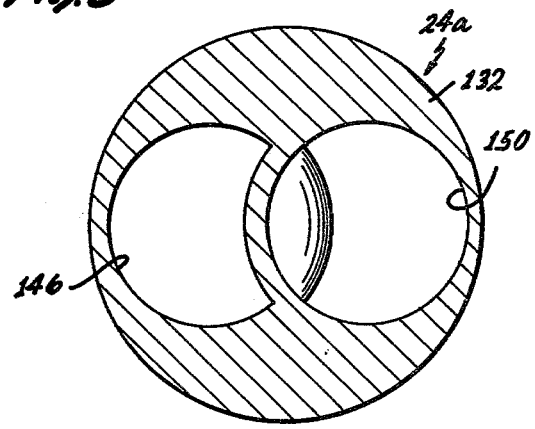
FIG. 9
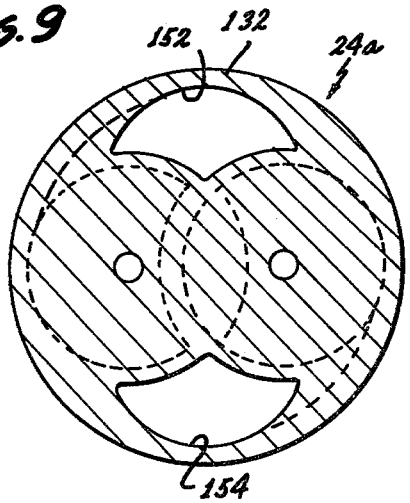

PUMPING ARRANGEMENTS TO CONSERVE ENERGY

BACKGROUND OF THE INVENTION

1. Field of the Invention

The board field of the invention is that of reduction of energy requirements in the operation of mechanical equipment and, more particularly, pumping equipment. The energy conserving characteristic of the invention is particularly adaptable in the field of deep well pumps which may be either water or oil pumps.

2. Description of the Prior Art

Pumps as such are, of course, well known in the art including pumps adapted for pumping water from ordinary wells as well as pumps utilized in deep wells pumping either water or oil or the like. Generally speaking, the energy required in operation of pumping equipment has not been a critical consideration until more recently when the conservation of energy has become of great importance. In pumping equipment as typically known in the prior art, normally, a heavy piston is utilized equipped with sealing rings which may themselves have considerable weight. Normally, a heavy metal sucker rod is provided which is a rod connected between the piston and the actuating equipment at the surface. As may be seen, very substantial amounts of weight are involved and the power and energy required for operation is proportionately great. In fact, the activation of some wells becomes economically prohibitive simply because the energy requirements are such that the cost of the energy makes activation of the well unprofitable.

The relative cost of the energy necessary to operate pumps has many implications from the standpoint of economics and in various fields. In the field of agriculture, the economics, of course, involves capital cost of the land as well as the continuing costs of water and fertilizer. The costs of water may depend largely upon the costs of energy necessary to provide the water. Thus, the feasibility of an agricultural project may hinge on the energy costs necessary to provide water. Accordingly, the capability of obtaining water more cheaply by reason of needing less energy to pump it has compelling significance. The implications of energy necessary to operate pumping facilities have significance in various other fields as well.

SUMMARY OF THE INVENTION

As indicated in the foregoing, the primary significance of the invention is that of reducing the power and energy requirements necessary to operate pumping facilities. The objects of the invention are realized in various ways.

In the preferred form of the invention, a pumping means of facility is provided which may be for a deep well or otherwise in which duel oppositely reciprocating pistons are utilized. The two pistons are connected by a cable passing over a pulley in such a way that when one piston is being pulled up, the other is being pulled down. Gravity is not relied on for moving either piston downwardly. The weight of the assemblies is greatly reduced. The pistons are constructed to be light-weight. For purposes of lightness in weight, bellows-type seals are utilized which preferably may be of the type known commercially as Bellofram seals. Heavy sucker rods as such are eliminated, the dual pistons being operated by cables operating over pulleys and attached to opposite ends of a walking beam. No heavy counterweight is used with the walking beam so that loss of energy in lifting such a counterweight is avoided. Valves used are of a particular construction which reduce the amount of pressure drop through the valve necessary for its operation so that the loss of energy in this respect is reduced. The elimination of piston rings sliding against cylinder walls further contributes to energy conservation.

Further improvements reside in particular constructional arrangements whereby the size of the pipe in the well bore can be reduced. This objective is realized by an offset staggered relationship of the pistons by having the pistons arranged vertically over each other or as described in detail hereinafter.

In the light of the foregoing, the primary object of the invention is to improve and modify constructional arrangements and techniques in relation to pumping equipment in a manner substantially to reduce the energy required for operation.

A further object is to realize the foreging by the use of light-weight dual pistons reciprocating oppositely to each other and actuated by way of cables connected to the pistons.

Another object is to realize weight and energy advantages by eliminating sliding seals and utilizing bellows-type seals.

Another object is to realize weight and energy advantages by use of valves which minimize the pressure drop through the valves and consequent energy losses.

A further object is to realize the foregoing by way of operating means consisting of a walking beam having no counterweight and having operating cables attached to opposite ends of the walking beam.

A further object is to provide and make available improved configurations and conformations of piping and piston arrangements wherein the cross-sectional area of piping is minimized by way of staggered offset relationships of the pistons or by arrangements of pistons vertically over each other.

Further objects and additional advantages of the invention will become apparent from the following detailed description and annexed drawings.

BRIEF DESCRIPTION OF THE DRAWINGS

FIG. 6 is a cross-sectional view of an improved form of the invention;

FIGS. 7, 8, 9, 10, 11 and 12 are cross-sectional views taken along the line 7—7, 8—8, 9—9, 10—10, 11—11 and 12—12, respectively, of FIG. 6;

DESCRIPTION OF THE PREFERRED EMBODIMENTS

Figure 1:
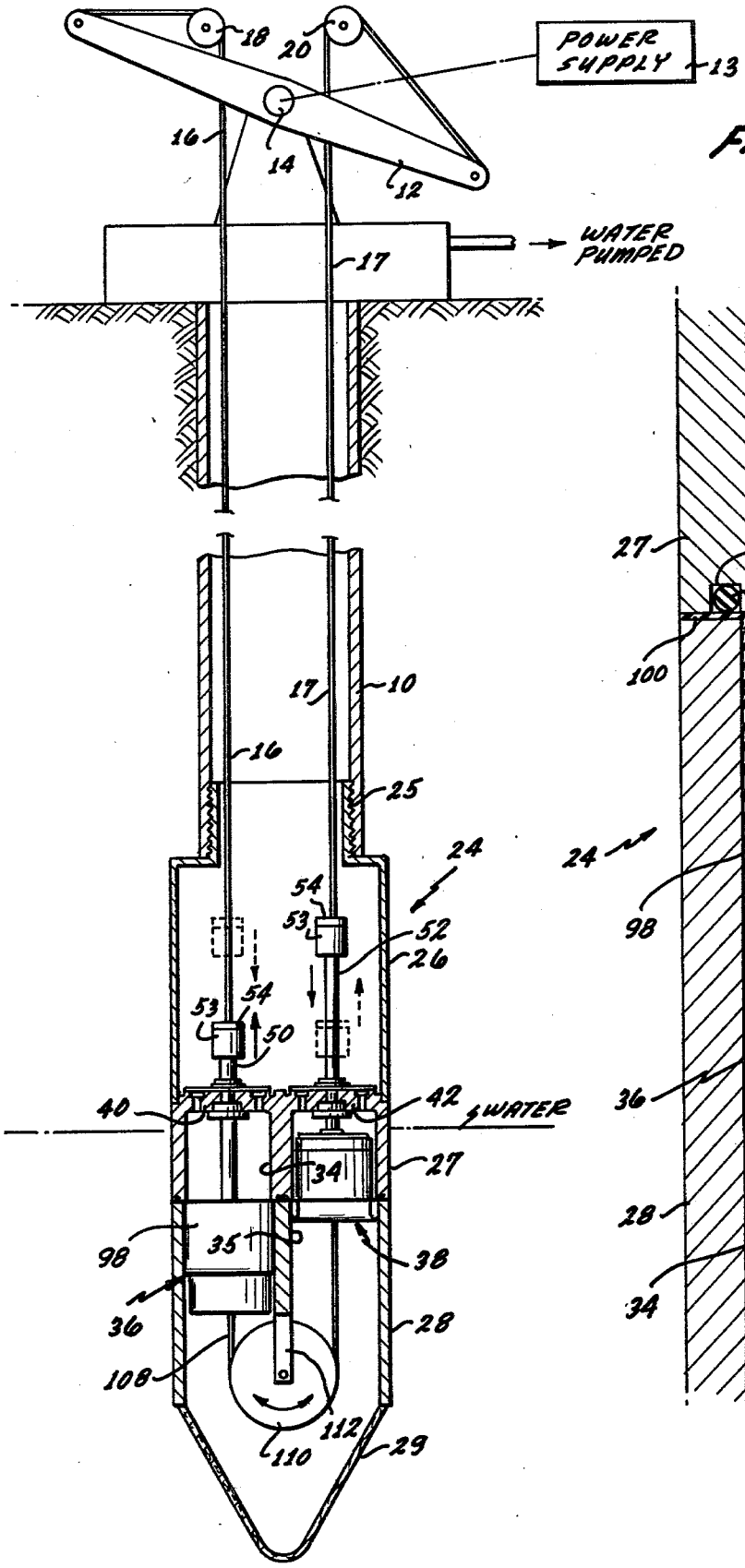
FIG. 1 is a cross-sectional view of the preferred form of the invention applied to a deep well pump.

A preferred embodiment of the invention is shown in FIGS. 1-5. In this embodiment, the invention is adapted in a deep well pump. FIG. 1 shows a well bore having a pipe 10 in it extending downwardly from a well head, the driving equipment being at the surface. Numeral 12 designated a walking beam which oscillates about a center pivot or arbor 14. It is, of course, power driven by a source 13. Attached to one end of the beam 12 is a cable 16, and attached to the other end is a cable 17, cable 16 moving over pulley 18 and cable 17 moving over pulley 20 so that the cables pass vertically down into the pipe 10 in the well bore.

Figure 3:
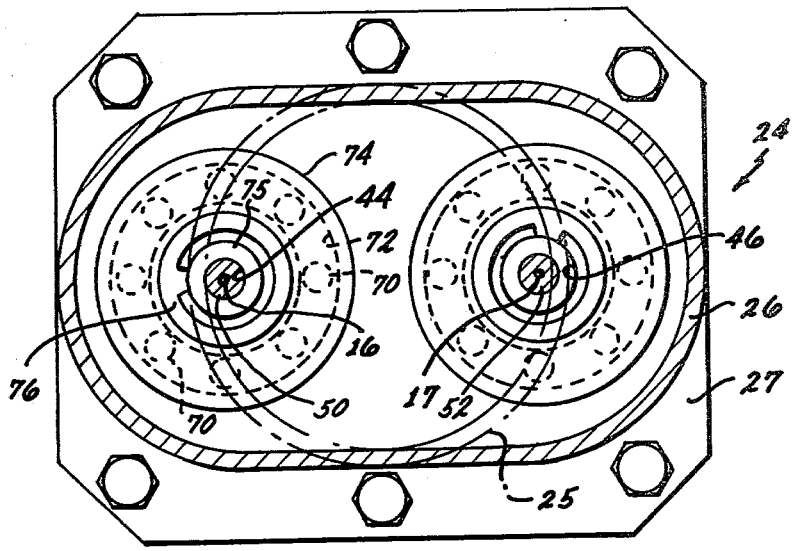
FIG. 3 is a cross-sectional view taken along the line 3—3 of FIG. 2.
Figure 5:
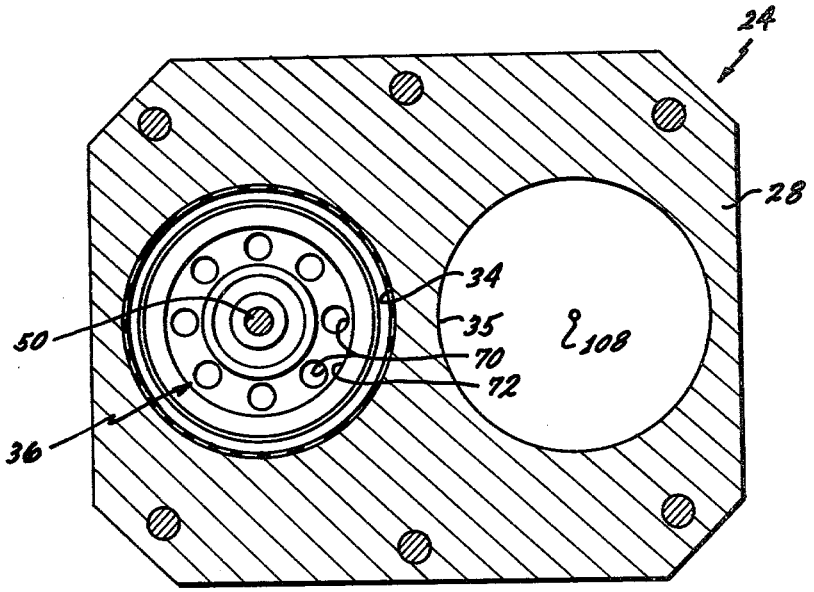
FIG. 5 is a sectional view taken along line 5—5 of FIG. 2.

At the lower end of the pipe 10 is a chamber or housing 24 which may be elongated in cross-section as shown in FIG. 3. It has an upper threaded tubular part 25 which threads into the lower end of the pipe 10 as shown. The chamber or housing 24 may be constructed in sections including an upper section 26, and intermediate section 27 and a lower section 28, the lower end of which is tapered as shown at 29.

Within the sections 27 and 28, are formed two cylindrical bores as designated at 34 and 35. These bores form cylinders for pistons as designated at 36 and 38. At the upper ends of bores 34 and 35 are closures or heads as designated at 40 and 42. The heads 40 and 42 have bores 44 and 46 through which extend piston rods 50 and 52. At the upper end of the piston rod 52 is an enclosure including a cup-shaped bottom part 53 having a threaded bore with a V-shaped bottom. Numeral 54 designates a plug member that threads into the bore in part 53 and having a top flange as shown and having a central bore 56. The lower end of the member 54 is of inverted cone shape and received between it and the V-shaped bottom of the bore in part 53 is a ball 57 to which the cable 17 is attached. Thus, the cable 17 is joined to the piston rod 58 by way of the joint formed so as to allow freedom of angular movement to prevent twisting of the cable. The two piston assemblies are duplicates so the description of one applies to the other.

The bore 44 has a threaded counterbore 62 which receives a threaded gland nut 63 which has a bore 64 and a counterbore 65 in which is a sealing member 66.

Closure or head 40 has a number of ports arranged in a circle, one of them being designated at 70. Numeral 72 designates a circular groove which communicates with the upper ends of circularly arranged ports 70. Numeral 74 designates a flexible valve member which fits around hub 75 at the center of the head 40 which is held in position by ring 76. The valve member 74 will be referred to again presently.

Figure 2:
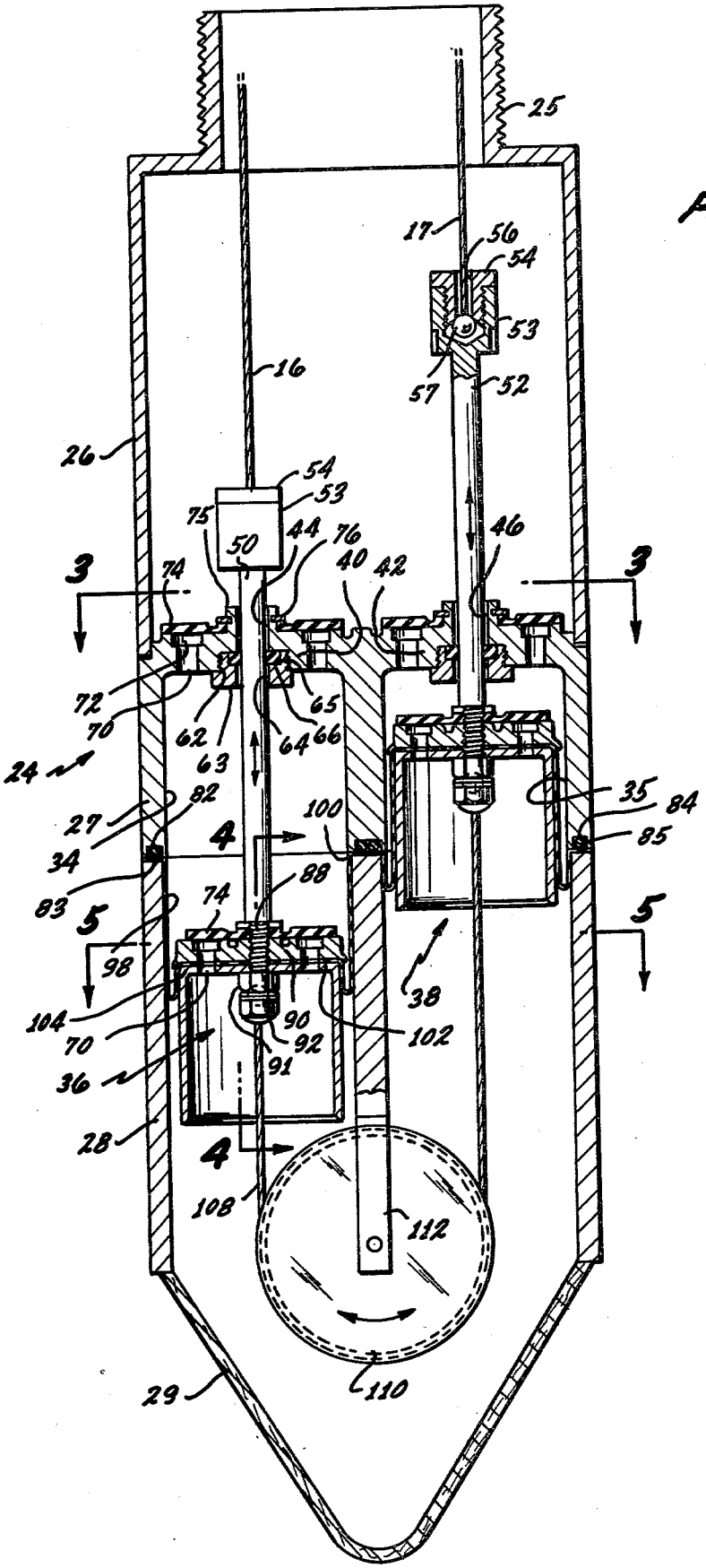
FIG. 2 is an enlarged cross-sectional view of the pistons of FIG. 1.

The sections 27 and 28 of the chamber 24 are joined together and sealing means are provided at the joint. Referring to FIG. 2, numeral 82 designates an annular groove formed around the bore 34 in the section 27 and in this groove is a sealing ring 83 that seals against section 28. Formed around the bore 35 in section 27 is an annular groove 84 in which is a sealing ring 85 that seals against section 28.

Figure 4:
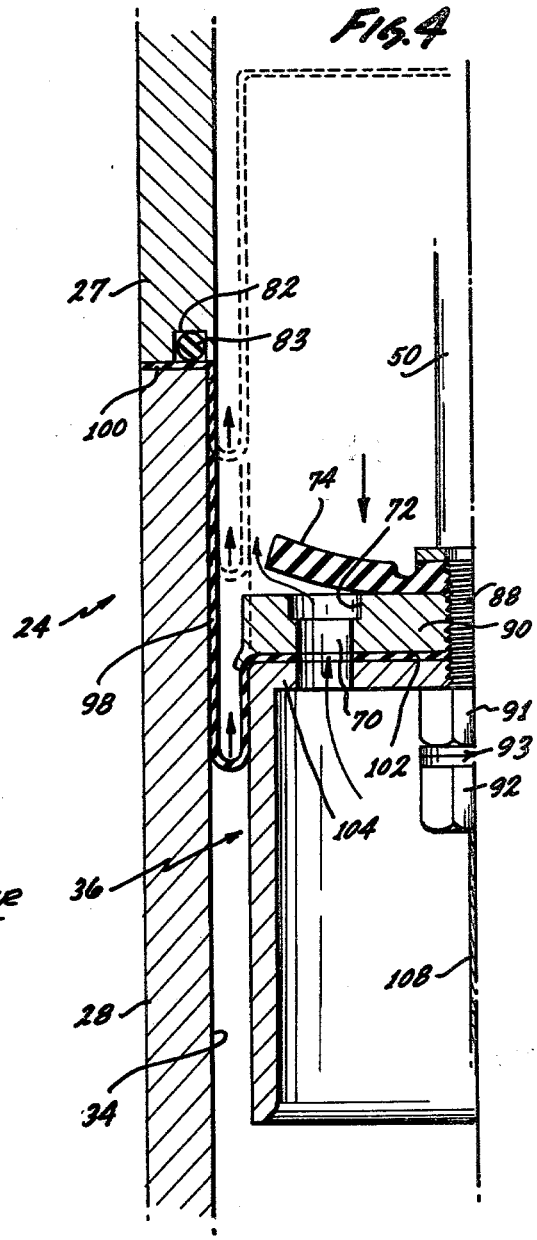
FIG. 4 is an enlarged sectional partial view of one of the pistons of FIGS. 1 and 2.

The piston 36 is shown in greater detail in FIG. 4. Piston rod 50 has a threaded end part 88 passing through piston head 90 of the piston 36 and securement is by way of nuts 91, 92 and washers 93. The construction of the piston head is like that of the cylinder head 40 and accordingly corresponding parts are identified by the same reference numerals. Piston head 90 has ports arranged in a circle, one of them being designated by numeral 70. Numeral 72 designates an annular groove as previously described. The valve member is designated at 74. By reason of the circular groove 72 with which all of the ports 70 communicate, the amount of movement required of the valve, which is a flapper valve, to provide the desired degree of opening is substantially reduced. The exposed port area is a function of the distance of the flapper valve away from the holes. The construction as shown reduces the amount of pressure drop through the valve which represents a loss and accordingly, the construction has significance from the standpoint of energy conservation considerations.

The piston 36 is not sealed by way of the usual heavy sealing rings having sliding engagement with the cylinder walls but rather, the piston is sealed by way of a bellows-type seal which may be of the type known commercially as a Bellofram seal. The bellows-type seal is designated at 98. It is made of flexible material which may be of the type that bellows are normally formed from. The upper end of the bellows-type seal as designated at 100 is clamped between the joined sections 27 and 28 as may be seen. The member 98 has a diameter so that normally it lies against the inside surfaces of the bore 34. The lower end of the seal as designated at 102 is clamped between the piston head 90 and the upper end of the piston as designated at 104. FIG. 4 illustrates the operation and function of the seal during reciprocation of the piston. As the piston moves up, the seal takes a position and changes in configuration as illustrated in dotted lines.

Numeral 108 in FIG. 2 designates a cable extending from the head of piston 36 and aligned with the piston rod 50. Numeral 110 designates a pulley journalled on an arbor or pivot stem carried by an extension 112 at the center of the chamber 24. The cable 108 passes around the pulley and is then attached to the center of the other piston 38 as may be seen in FIGS. 1 and 2.

The pistons are constructed to be as light as possible. No counterweight is used with the beam 12. The two pistons reciprocate, one going up while the other goes down. The liquid being pumped enters through ports formed in the conical end part 29. As can be seen, the amount of mass that is moved is greatly reduced. The friction of sliding seals sliding on the inside of a bore is eliminated. The cables pull one piston up while the other pulls down. As can readily be observed, the amount of energy required for operation is very substantially reduced and the economics are improved accordingly.

FIGS. 6-13 show a modified form of the invention utilizing the same principles. This form of the invention is characterized by a configuration making it possible to reduce the size of the piston chamber or chambers. In this form of the invention, the piston chamber is designated at 24*a*, this chamber corresponding to chamber 24 of the previous embodiment. In this form of the invention, the piston chambers are not side-by-side but rather, one is over the other in a staggered or offset relationship. Furthermore, two pairs of dual pistons are provided, one pair being over the other. Parts in this embodiment corresponding to similar parts in the previous embodiment are identified by the same reference numerals to avoid duplication of description. The second pair of pistons and associated parts are identified by corresponding reference numerals including the letter a.

The pistons in FIG. 6 are shown schematically but include bellows-type seals as described in connection with FIGS. 1-5. The pistons are provided with valves as described in connection with the previous figures and accordingly, the description need not be repeated.

The chamber or enclosure 24a in FIG. 6 is formed of joined sections identified by the numerals 130, 132, 133 and the bottom conical section 134 which are joined together in sealing relationship as described in connection with FIG. 2.

There is a cylinder head 136 which accommodates the cylinders having pistons 36 and 38 in them. There is a lower cylinder head 140 which accommodates the cylinders for pistons 36a and 38a. The piston rods are sealed as described in connection with the previous embodiment.

The pistons 38 and 38a are aligned and are connected by a cable 120. Pistons 36 and 36a are aligned and are connected by a cable 122, the cables connecting to the respective piston rods. The pistons and seals are like those of the previous embodiment.

Figure 13:
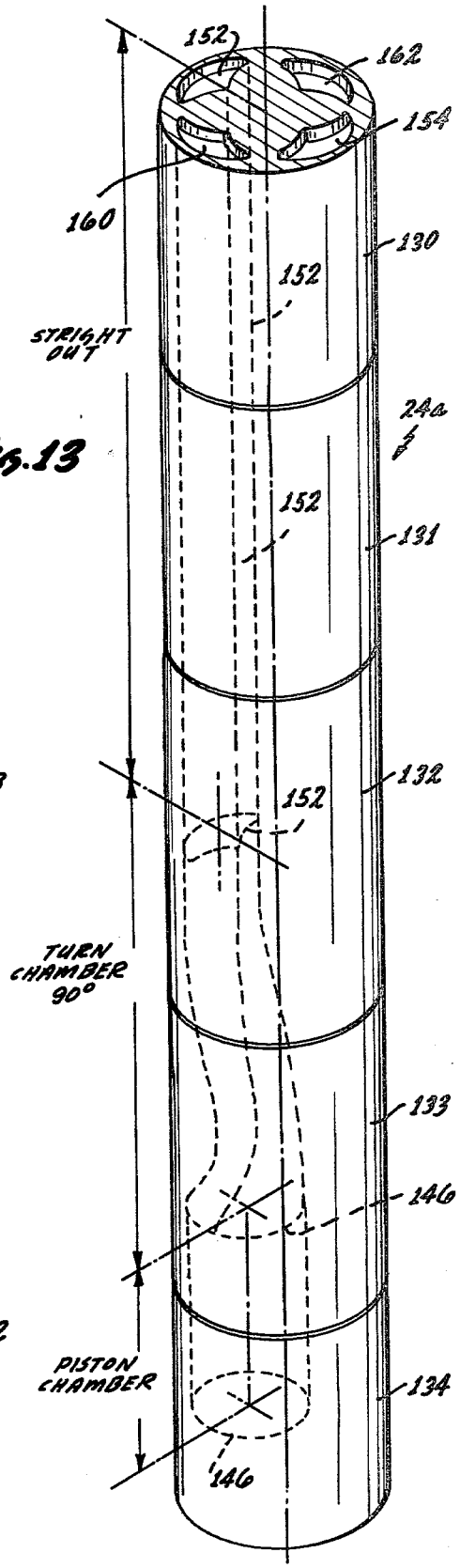
FIG. 13 is an illustrative view of the channels formed within the pipe of FIG. 6.

The bores for the pistons 36 and 38 and for the pistons 36a and 38a are offset or staggered rather than being in vertical alignment. All four of the bores have communication through the head 36 into the upper part of the pipe 24a. FIG. 13 illustrates ports at the upper ends of the channels communicating with the bores as will be described presently.

Numeral 144 designates a valve like the valves of the previous embodiment which cooperates with all of the openings in the head 136 to control the flow of pumped liquid.

The shape and configuration of the bores and communicating channels may be understood from the cross-sectional views 7-12 and FIG. 13. Referring to FIGS. 7 and 8, numeral 146 designates the bore for piston 36a. Numeral 148 designates a channel providing communication from the openings 29 to the bore 150 for piston 38a as may be seen in FIG. 8. FIG. 9 shows channels 152 and 154 which are above the cylinder head 140 providing communication to the bores 156 and 158 for the pistons 36 and 38 respectively.

Figure 10:
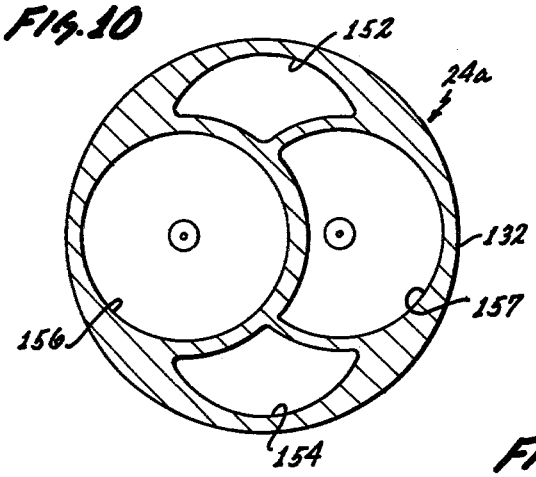
Figure 11:
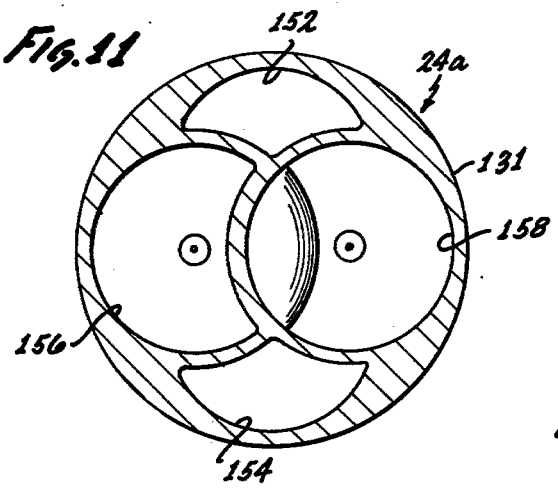
Figure 12:
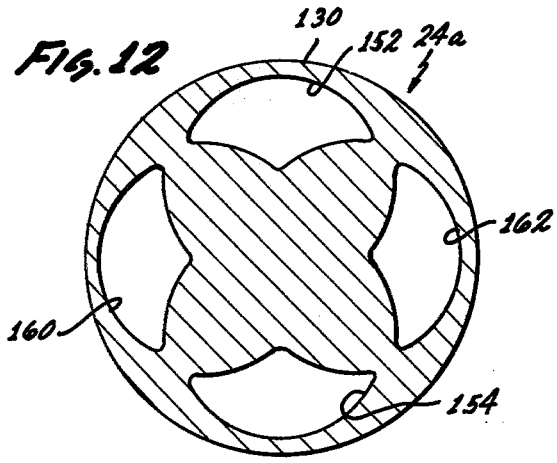

The cross-sectional view of FIG. 10 shows the bore 156, channel 157 providing communication to the bore 158 and the communicating channels 152 and 154. FIG. 11 shows the two bores 156 and 158 and the channels 152 and 154. FIG. 12 shows the channels 152 and 154 and the channels 160 and 162 that communicate with the bores 156 and 158, the valve 144 cooperating with all of these ports, that is, the ends of these channels. The configuration of the communicating channels is illustrated schematically in FIG. 11 in broken lines.

Chamber 24a in FIG. 6 is provided with a circumferential inlet as designated at 170 in the sidewalls of the chamber 24a for liquid for the pistons 36 and 38. Water for the pistons 36a and 38a is through the openings in concial portion 29 at the lower part of chamber 24a.

The operation of the present embodiment is like that of the previous embodiment except that the dual tandem pistons 36 and 36a operate together while the dual tandem pistons 38 and 38a operate together. The rate of pumping is proportionately increased with all of the pistons in a singular tubular member the size of which is minimized by the staggered or offset relationship of the pistons.

Figure 14:
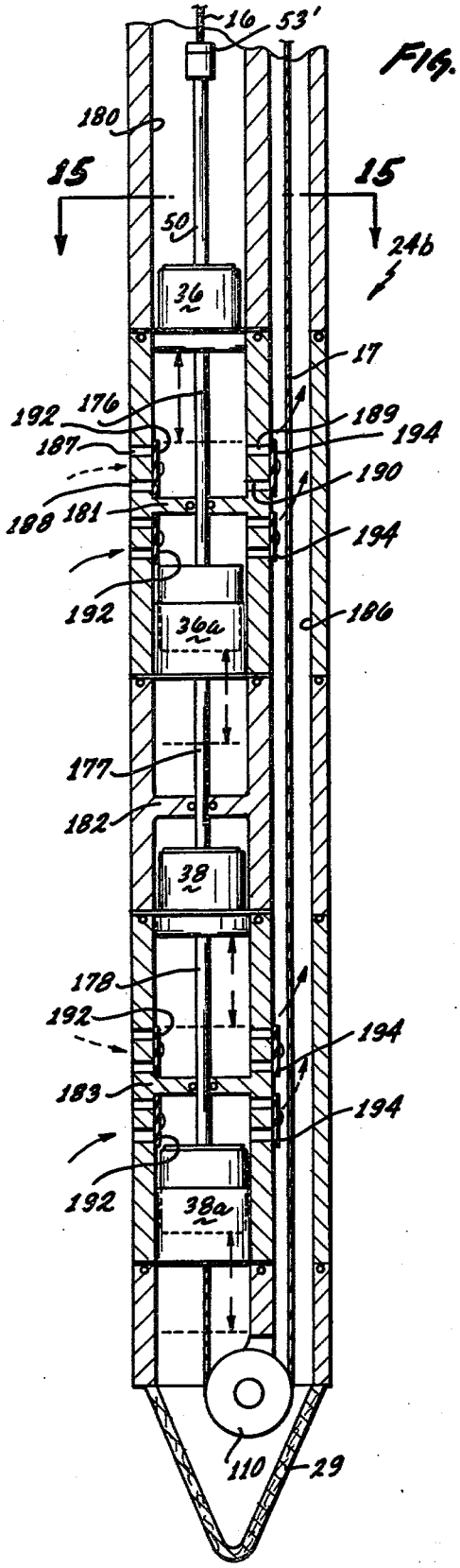
FIG. 14 is a cross-sectional view of another modified form of the invention.

FIG. 14 is a cross-sectional view of a further modified form of the invention. The parts which are the same or which correspond to parts described in previous embodiments are identified by the same reference numerals. The tubular chamber is identified by the numeral 24b in this embodiment. This embodiment is provided with the pistons 36, 36a, 38 and 38a with all pistons vertically aligned as shown. Pistons 36 and 36a are connected by a piston rod 176. Pistons 36a and 38 are connected by a piston rod 157 and pistons 38 and 38a are connected by a piston rod 178. Pistons are sealed as in the previous embodiments. The member 24b is provided with an elongated bore as designated at 180 having in it partitions forming cylinder heads as designated at 181, 182 and 183, the piston rods being sealed as in the previous embodiments. At one side of the bore 180 is a crescent-shaped elongated bore or channel as designated at 186. The cable portion 17 passes through this channel.

Inlet and out valves are provided for the bore sections in which each of the four pistons operate. Just above the head 181 are inlet ports 187 and 188 and opposite to them are outlet ports 189 and 190 communicating with the channel 186. Numeral 192 designated a cylindrical flexible valve member associated with the inlet ports 187 and 188 which operates in a manner similar to the valves of the previous embodiment. Numeral 194 designates a similar valve member associated with the ports 189 and 190 on the outside of the bore 180 which operate similarly as a discharge valve discharging into the channel 186. Just below the head 181 is a similar pair of valves which, since they are alike, need not be described in detail. Above and below the head 183 are similar pairs of inlet and outlet valves for the pistons 38 and 38a.

From the foregoing and from the description of the previous embodiment, the operation of the present invention will be readily understood. All pistons move up at the same time together and they all move down together. On the upward stroke, the pistons 36 and 38 are causing liquid to be drawn into the cylinder bores underneath these pistons. At the same time, pistons 36a and 38a are pumping liquid out of the discharge ports above these pistons.

On the down stroke or downward movement, the cylinders 36 and 38 are pumping whereas the pistons 36a and 38a are drawing liquid into their respective cylinder bores. Each reciprocation accordingly represents a working stroke of two pistons. As may be seen, the constructional arrangement is very compact and simplified but yet very effective for the purpose of maximizing pumping effort with the minimum expenditure of energy.

Figure 15:
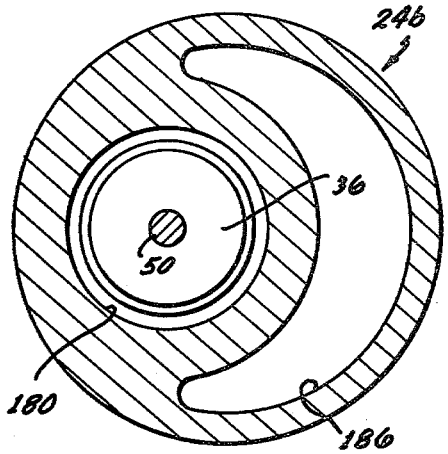
FIG. 15 is a cross-sectional view taken along the line 15—15 of FIG. 14.
Figure 16:
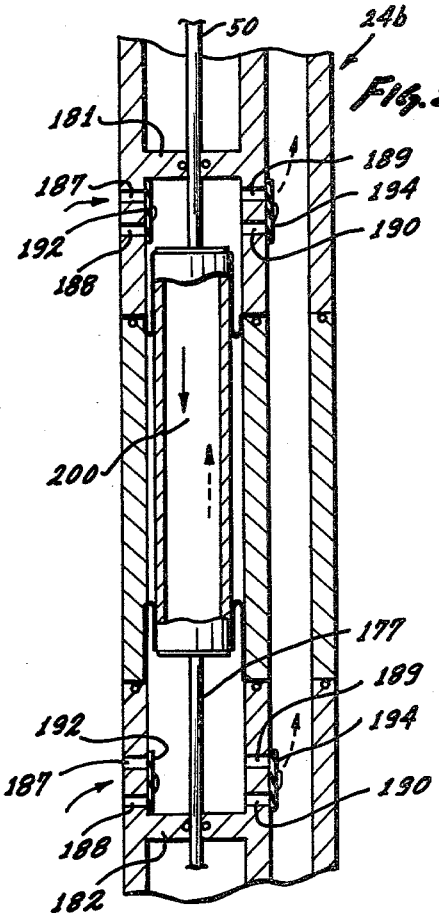
FIG. 16 is a partial sectional view of another modified form of the invention.

FIG. 16 shows a modified form of the invention which is a further modification of the form shown in FIGS. 14 and 15. The modification is that the pistons 36a and 38 of FIG. 14 are constructed in the form of a single piston as designated at 200. Thus, whereas pistons 36a and 38 are separate pistons with a stem between them in FIG. 16, these pistons are constructed as a single double-ended piston 200. The valving and porting arrangements and the construction is otherwise like that of FIG. 14.

Pistons 38 and 38a also are constructed as a single double-ended piston. As may be seen, the construction is simplified in the elimination of piston rod heads and associated seals.

From the foregoing, those skilled in the art will readily understand the nature and construction of the invention and the manner in which it achieves and realizes the objectives as set forth in the foregoing. Particularly, the invention makes a very substantial advance from the standpoint of conservation of energy which currently is an extremely significant factor. All of the elements of the combinations of the attached claims are integrated and very clearly cooperate with each other. The concept of assembling the combination and the implementation thereof are unobvious and the combination as a whole is synergistic, the combination as a whole being something more than previously existed in relation to the particular elements. There is difference also in the elements and particularly in their constructional association with each other so that the synergism lies in the realization of the conservation of energy which clearly would not result from a bare assocation of basic elements related to the concept and implementation of the herein invention.

The foregoing disclosure is representative of preferred forms of the invention and is to be interpreted in an illustrative rather than a limiting sense, the invention to be accorded the full scope of the claims appended hereto.

What is claimed is:

1. In a pumping system, in combination, a pump cylinder having a cylinder bore, a piston reciprocatable in the bore, the cylinder being in a well bore, pipe means providing communication to the surface, and flexible cable means for producing reciprocation of the piston in the bore, pulley means over which the cable means passes and means for imparting reciprocatory movement to the cable means, said last means including a walking beam, opposite ends of said beam being connected to the cable means, a second similar cylinder bore having a second piston in it, the cable means including a section connecting between the pistons whereby the pistons move in opposite directions, both said cylinder bores and said pulley means being within the pipe means, said cylinders having pistons which reciprocate oppositely to each other and a second pair of dual cylinders and pistons which reciprocate oppositely to each other, means connecting pistons whereby two of the pistons move together in each direction, first vertically aligned bores in which pistons which move together respectively operate, and second vertically aligned bores in which the other pair of pistons which move together respectively move, the said respective first bores and second bores being laterally spaced from each other, the said first bores and said second bores being offset from each other by an amount that is less than the diameter of the pistons.

2. In a pumping system for a well having a pipe extending downwardly into said well:

a pair of laterally spaced cylinder means in said pipe in a lower region of said well;

piston means slidable in each cylinder means;

a cable secured to the upper end of each piston means and extending upwardly in said pipe, said cables being secured at their upper ends to respectively opposite ends of a walking beam;

a pulley journalled in said pipe below said piston and cylinder means;

a further cable trained over said pulley with its opposite ends extending upwardly and being secured respectively to said laterally spaced piston means;

said pistons being spaced from their cylinder walls and a rolling diaphragm seal between said pistons and cylinders; and ports through said pistons and flexible valve members on said pistons for closing said ports.

* * * * *